United States Patent [19]

Cotic et al.

[11] Patent Number: 4,909,375

[45] Date of Patent: Mar. 20, 1990

[54] AUTOMATIC TIE PLATE SORTING CONVEYOR

[75] Inventors: Dennis J. Cotic, Waukesha; John L. Thorson, Wauwatosa, both of Wis.

[73] Assignee: Oak Industries, Inc., Rancho Bernardo, Calif.

[21] Appl. No.: 203,486

[22] Filed: Jun. 7, 1988

[51] Int. Cl.[4] ..... B65G 47/14

[52] U.S. Cl. ..... 198/393; 198/397; 198/398; 198/635; 198/690.2; 221/159

[58] Field of Search ..... 198/393, 397, 398, 635, 198/688.1, 698, 690.2, 853, 851; 221/159, 162

[56] References Cited

U.S. PATENT DOCUMENTS

| | | | |
|---|---|---|---|
| 1,424,090 | 7/1922 | Foster et al. | 198/698 |
| 1,638,267 | 8/1927 | Morehead et al. | 198/690.2 |
| 2,466,240 | 4/1949 | Joa | 198/698 X |
| 2,796,972 | 6/1957 | Jeffras Sr. | 198/698 |
| 2,930,473 | 3/1960 | Campbell | 198/397 |
| 3,433,966 | 3/1969 | Letch et al. | 250/223 |
| 3,721,328 | 3/1973 | Drew | 198/635 |
| 3,882,785 | 5/1975 | Rowe | 104/16 |
| 3,943,858 | 3/1976 | Dieringer et al. | 104/16 |
| 4,178,671 | 12/1979 | Luttig | 29/429 |
| 4,241,663 | 12/1980 | Lund et al. | 104/16 |
| 4,280,613 | 7/1981 | Stewart | 198/406 |
| 4,393,784 | 7/1983 | Theurer | 104/2 |
| 4,727,989 | 3/1988 | Cotic et al. | 209/546 |
| 4,735,343 | 4/1988 | Herzog | 198/397 X |

FOREIGN PATENT DOCUMENTS

| | | | |
|---|---|---|---|
| 433627 | 9/1926 | Fed. Rep. of Germany | 104/16 |
| 508470 | 9/1930 | Fed. Rep. of Germany | 198/398 |
| 1171718 | 6/1964 | Fed. Rep. of Germany | 198/397 |
| 2632043 | 1/1978 | Fed. Rep. of Germany | 198/397 |
| 2805927 | 8/1979 | Fed. Rep. of Germany | 198/698 |
| 2905492 | 8/1980 | Fed. Rep. of Germany | 198/397 |
| 308954 | 3/1969 | Sweden | 310/198 |
| 386049 | 10/1973 | U.S.S.R. | 104/16 |
| 509398 | 4/1976 | U.S.S.R. | 313/398 |
| 644897 | 1/1979 | U.S.S.R. | 104/16 |
| 652257 | 3/1979 | U.S.S.R. | 104/16 |
| 0724322 | 3/1980 | U.S.S.R. | 221/159 |
| 765445 | 9/1980 | U.S.S.R. | 104/16 |

OTHER PUBLICATIONS

"An Attraction for OTM", Railway Track and Structures, Mar. 1986, pp. 29–31.

*Primary Examiner*—David A. Bucci
*Assistant Examiner*—D. Glenn Dayoan
*Attorney, Agent, or Firm*—Welsh & Katz

[57] ABSTRACT

A sorting conveyor for rail tie plates or the like including an inclined frame having an upper end and a lower end, and an endless conveyor belt formed of a plurality of links pivotally joined to each other. The links are designed to have plate retaining pockets formed thereon and the belt is adapted to travel a contoured path on the frame between the lower end and the upper end. The belt has an upper working strand and a lower slack strand. A hopper provides a supply of randomly oriented tie plates to the lower end of the conveyor which are agitated or tumbled by the action of the moving conveyor belt. At least one rejector hook is provided to ensure proper positioning of the plates within the pocket. As the conveyor belt progresses towards the upper end of the frame, certain plates are oriented properly within the plate pockets and will be conveyed to the upper end of the frame through the movement of the conveyor belt. Plates which are not properly oriented are rejected from the conveyor belt by the rejector hook which flings the plates back to the lower end of the conveyor for eventual proper placement within the pockets.

26 Claims, 1 Drawing Sheet

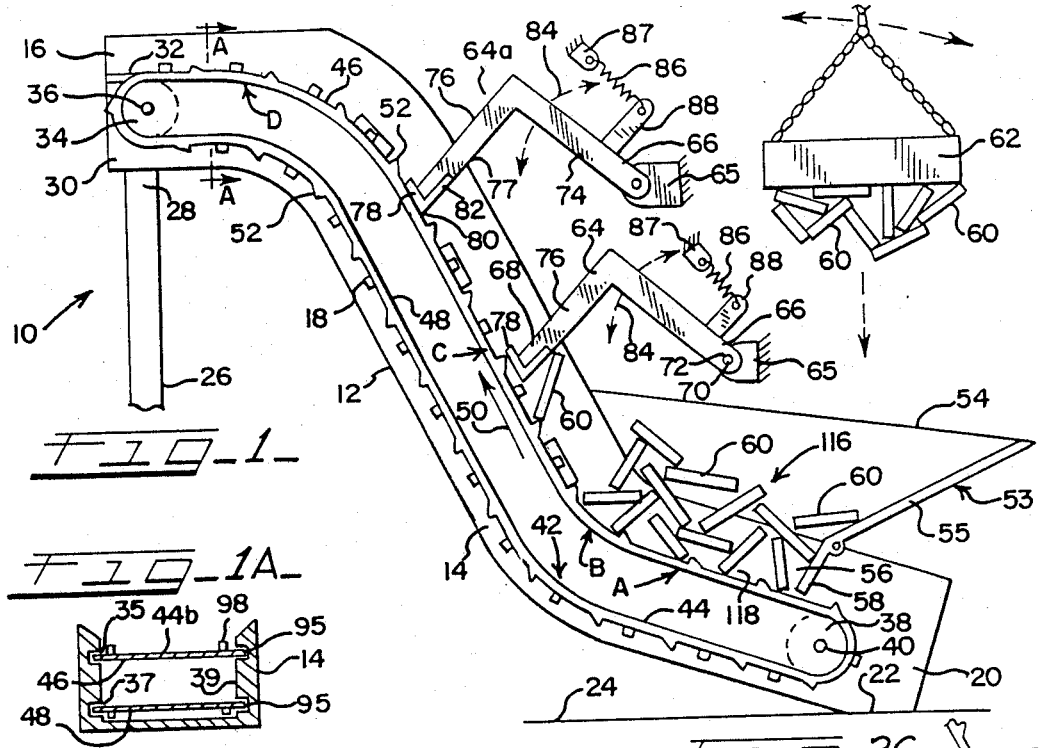
FIG. 1
FIG. 1A
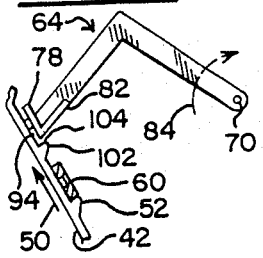
FIG. 2A
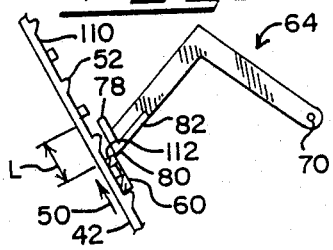
FIG. 2B
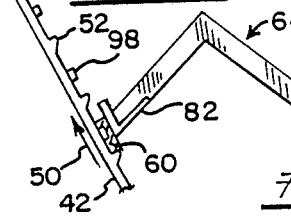
FIG. 2C
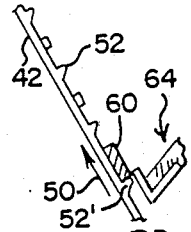
FIG. 2D
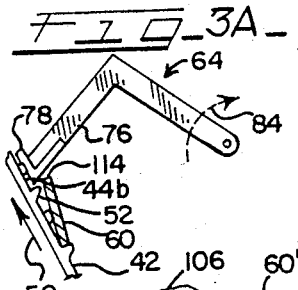
FIG. 3A
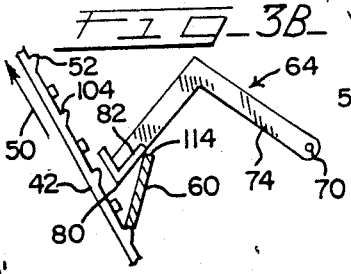
FIG. 3B
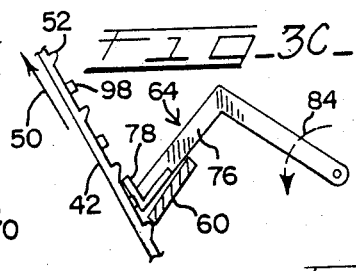
FIG. 3C
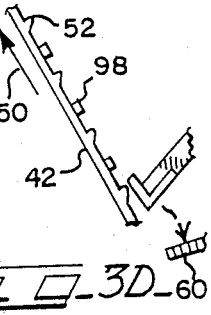
FIG. 3D
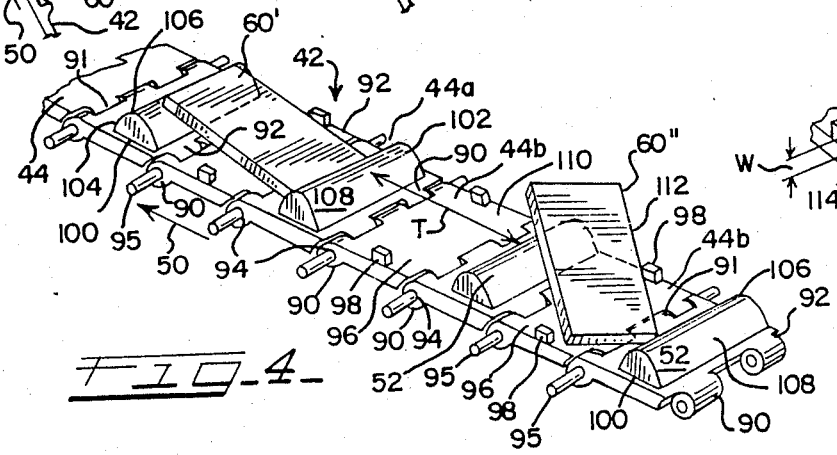
FIG. 4
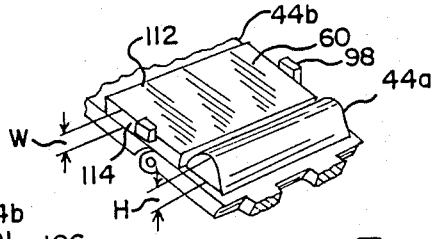
FIG. 5

AUTOMATIC TIE PLATE SORTING CONVEYOR

BACKGROUND OF THE INVENTION

The present invention relates to machines for repairing or reconditioning railroad rights-of-way and more specifically relates to a conveyor apparatus for orienting randomly stored rail tie plates in a desired length-to-width position and for transporting the oriented plates for subsequent further handling prior to placement of the plates upon railroad ties.

The invention disclosed in the present application is related to the invention disclosed in co-pending application Ser. No. 203,328, filed June 7, 1988, titled "Method and Apparatus for Automatically Setting Rail Tie Plates".

Tie plates are used to secure rails to railroad ties and comprise a generally flat steel plate with a substantially flat bottom, a plurality of spike holes located on opposite side ends of the plate, and an upper surface having a pair of parallel, vertically projecting rail securing ribs which define a rail seat therebetween. The tie plate upper surface is slightly angled to provide an inwardly canted rail seat, with more mass located on the field side of the plate to compensate for the force distribution of trains negotiating curves at high speed.

In the process of reconditioning railroad rights-of-way, the existing rail is removed along with the spikes and tie plates, the ties are replaced or resurfaced, and the track bed is refurbished. Before new rails are laid, replacement or recycled tie plates must be accurately positioned upon the ties.

Tie plate replacement is a cumbersome and labor-intensive operation, due to the significant weight of the individual plates (18–40 lbs. each) and the rapid rate at which they must be positioned to keep up with the other operations of track reconditioning, most of which are largely automated. Normally a member of a plate handling crew must retrieve steel plates individually from an often tangled pile and properly orient each plate for setting upon the upper surface of a tie to form new track beds. Two hands are required to position each plate due to their size and significant weight. If the plate is inverted, a worker must get his fingers under the plate and turn it over. Typically this is done on the ground or on a steel table surrounded by other plates and track material. Accurate plate placement is critical, for the plates are required to be positioned within ¼ inch on an imaginary x-y plane parallel to the ground. It has been estimated that a member of a plate feeding crew will handle 150,000 pounds per 8 hour shift. In order for the manual plate setting operation to keep up with the other automated track reconditioning operations of the rail gang, the workers must lay plates at 30 to 40 plates per minute for maximum rail gang efficiency. Considering the relatively rapid rates of placement required, as well as the degree of accuracy required, operator effort and safety become major concerns.

Previous attempts at automating the tie plate setting operation resulted in devices largely concerned with the actual placement of the plate on the ties. These prior art setters depended on a supply of plates which had already been manually oriented, either on or off-site. On-site, plates are often prepositioned along the shoulder of the track bed, or carried in a gondola to be fed via conveyors to the plate setting device. However, the rapid rate of 30 to 40 plates per minute at which automatic tie plate setters must operate to keep up with other automated track maintenance equipment requires extensive preplacement and manual handling and sorting of plates.

Accordingly, the automatic tie plate sorting conveyor of the invention is designed to receive randomly oriented tie plates and to orient them in proper length-to-width position for subsequent mechanical handling and eventual placement upon the rail tie. The machine is designed to accommodate a large variety of tie plate size configurations and may be integrated with a larger plate handling device traveling at a constant speed over the rail bed.

SUMMARY OF THE INVENTION

A sorting conveyor for rail tie plates for a railroad track is designed to receive a supply of randomly-oriented rail tie plates, to orient them in proper length-to-width position, and to convey the oriented plates to an appropriate plate handling device for further orientation and eventual placement upon the upper surfaces of railroad ties.

More specifically, the conveyor includes a frame having an upper end and a lower end, and an endless conveyor belt formed of a plurality of links, each link being pivotally joined to adjacent links, and the links having formations thereon designed to form plate retaining pockets. Each pocket is dimensioned to accommodate only one tie plate in proper length-to-width orientation for placement. The conveyor belt is adapted to travel a contoured path upon the frame between the lower and upper ends of the frame. A hopper is provided at the lower end of the frame in communication with the conveyor belt and is designed to retain a supply of randomly oriented tie plates and to supply the plates to the lower end of the conveyor. As the conveyor belt moves beneath the stored plates, it provides an agitating force which causes certain of the plates to be wholly retained in the pockets of the moving belt in proper length-to-width orientation for placement upon the ties. Whether the plates in the pockets are inverted or right side up will not interfere with their being conveyed by the conveyor of the invention. Other plates will be only partially located within the pockets. At least one rejecter hook is mounted to the frame and positioned above the conveyor belt so as to intercept those plates on the upper or loaded strand of the belt which are not properly oriented within the pockets. When the rejecter hook encounters a misaligned plate, the hook engages the plate and forces it back down to the lower end of the conveyor where it joins the supply of agitated, randomly oriented plates. Through the continuous movement of the conveyor belt and the action of the rejecter hook, the randomly oriented plates in the hopper are realigned so that eventually all of the plates will properly fall into a pocket of the belt for subsequent conveying to the upper end of the conveyor.

BRIEF DESCRIPTION OF THE DRAWINGS

FIG. 1 is a diagrammatic side elevational view of the sorting conveyor for rail tie plates of the invention wherein a side wall has been removed for purposes of explanation;

FIG. 1A is a diagrammatic sectional elevation taken along the line A—A of FIG. 1 and in the direction indicated generally;

FIGS. 2A–2D are diagrammatic fragmentary side elevational views of the conveyor depicted in FIG. 1 and chronologically depict the cycle of operation of a rail tie plate properly oriented upon the conveyor belt;

FIGS. 3A–3D are diagrammatic fragmentary side elevational views of the conveyor depicted in FIG. 1 and chronologically depict the interaction between the rejecter hook and a rail tie plate improperly oriented on the conveyor belt;

FIG. 4 is a perspective elevation of the conveyor belt of the invention depicting tie plates located thereon in misaligned length-to-width orientation; and FIG. 5 is a fragmentary perspective elevation of the conveyor belt as described in FIG. 4 depicting a plate properly oriented thereon.

DESCRIPTION OF THE PREFERRED EMBODIMENT

Referring to the drawings, wherein like reference characters designate like characteristics, FIG. 1 depicts a sorting conveyor for rail tie plates or the like designated generally by the reference numeral 10. The conveyor 10 is designed to be either mounted to a movable frame for independent movement along the rail bed or alternatively may be mounted to a larger rail tie plate orientation machine or other rail right-of-way maintenance machine. The details of the type of machine used to move the conveyor along the track are not pertinent to the operation of the present invention and as such have been omitted herein. The conveyor 10 includes a contoured frame 12 having a pair of sidewalls 14 with a generally 'S'-shaped configuration and including an upper end 16, a central portion 18 and a lower end 20. For purposes of explanation, in FIG. 1 the conveyor 10 is shown with one of the sidewalls removed. The lower end margin 22 of the lower end 20 is adapted to rest upon the substrate 24 which may be a base plate or a portion of the aforementioned machine. A vertical support member 26 is secured at an upper end thereof 28 to the lower edge margin 30 of the upper end 16 of the frame 12. The lower end of the vertical support 26 (not shown) is secured to the substrate 24. The vertical support 26 may consist of a relatively wide beam, a pair of vertical legs or any alternative support means for maintaining the upper end 16 of the frame 12 in an elevated position. A horizontal discharge chute 32 is located at the upper end 16 of the frame 12.

An upper conveyor roll 34 is transversely mounted at the upper end 16 of the frame 12 for axial rotation about an axis represented by the shaft 36 which protrudes from both ends of the roll 34. The upper roll 34 is provided with a conventional power source (not shown) such as a motor of sufficient motive power to drive the loaded conveyor belt as described hereinbelow. In addition, the outer peripheral surface of the drive roll 36 may be provided with teeth or other suitable projections (not shown) designed to drive a conveyor belt. A lower conveyor roll 38 is located at the lower end 20 of the frame 12 in transverse orientation thereto and parallel to the upper roll 34. The lower roll 38 is also designed for axial rotation about an axis represented by the shaft 40 which projects from both ends of the roll 38 and may also be provided with teeth or suitable projections (not shown) designed to engage a conveyor belt. The shafts 36 and 40 are mounted to the sidewalls 14 of the frame 12 and are provided with suitable bearings (not shown). While the upper drive roll 34 is provided with a power source, the lower roll 38 is an idler roll and as such is designed for freewheeling axial rotation between the sidewalls 14.

An endless conveyor belt 42 is mounted around the upper and lower conveyor rolls 34, 38 and is designed to follow the contoured path defined by the sidewalls 14. This path contour includes a lower portion A having a gradual incline, an upwardly curving portion B and a relatively steeply inclined portion C. The inclined portion C leads to the substantially horizontal portion D, which is adjacent the horizontal discharge chute 32. The orientation of the belt 42 within the frame 12 may be maintained by upper and lower recesses or guides 35 and 37 provided on the inner faces 39 of the sidewalls 14 (best see in FIG. 1A). The recesses 35, 37 are engaged by laterally projecting pins 95 described in greater detail hereinbelow. The belt 42 is made up of a plurality of individual links 44 pivotally joined to each other (best seen in FIG. 4). The belt 42 further includes an upper, working or loaded strand 46 and a lower, slack or unloaded strand 48. The drive roll 34 is designed to move the upper strand 46 of the belt 42 in the direction indicated by the arrow 50. Alternate links 44 of the belt 42 are provided with cleats 52 located on the upper surfaces thereof and transverse to the direction of movement of the conveyor belt 42 indicated by the arrow 50.

A hopper 53 is mounted to the lower end 20 of the frame 12 and includes an enlarged upper opening 54, a funnel shaped portion 55 and a relatively smaller lower opening 56 which is in communication with the upper strand 46 of the belt 42. The hopper 53 includes a lower retaining wall 58 designed and positioned to retain the tie plates and prevent their escape from the upper strand 46 of the belt 42 to the lower end 28 of the frame 12. The hopper 53 is constructed and arranged to retain a plurality of randomly oriented tie plates 60 therein. The tie plates 60 may be loaded into the hopper 53 by means of an industrial or scrap iron type electromagnet 62 which is movable from a position directly above the opening 54 of the hopper 53 to a position (not shown) where a large supply of tie plates 60 may be stored. In that the plates 60 have a conventional configuration as described hereinabove, including a top side with a pair of ribs, a field side, a track side and a plurality of spike holes, for the purposes of the invention, the plates have been depicted as rectangular flat boxes.

At least one rejecter hook 64 is positioned above the upper strand 46 of the belt 42 and is mounted to the frame 12 by suitable support ears or members 65. In the preferred embodiment, two such rejecter hooks 64 are provided. Each hook 64 is an elongate member of substantially 'L'-shaped configuration including a pivot end 66 and a free end 68. The pivot end 66 is provided with a pivot bore 70 which is designed to matingly engage a pin 72 mounted to the support member 65. The pivot end 66 further includes a pivot leg 74 extending therefrom which intersects a free leg 76 on an approximate perpendicular or right angle and is integral therewith. The free leg 76 has a downward facing edge margin 77 and terminates at the free end 68.

A shoe 78 is secured to the free end 68 of the rejecter hook 64 in preferably releasable fashion, such as by tack welding or conventional fasteners (not shown). The shoe 78 is provided with an inclined or tapered leading edge 80. The shoe 78 is preferably manufactured of wear resistant materials such as high carbon steel or carbide impregnated alloys. In addition, a plate rejecter surface 82 fabricated of similar wear resistant material as is the shoe 78 may be provided as an integral portion of the shoe 78 and is designed to be secured to the edge margin 77. Alternatively, the rejecter surface 82 may be an individual component replaceable separately from the shoe 78. The rejecter surface 82 is designed to have a length at least as long as the longest tie plate 60.

The rejecter hooks 64 are adapted to pivot about the pivot pin 72 and travel a substantially vertical pivot arc designated by the reference numeral 84. A biasing force is provided to bias the rejecter hooks 64 against the upward motion of the conveyor belt as indicated by the arrow 50. This biasing force may be provided by a coiled tension spring 86 connected at one end to a spring lug 87 on the frame 12 and at the other end to a spring support 88 which is integral with, and projects vertically from the pivot leg 74 of the rejecter hook 64. Contact between the shoe 78 and the upper strand 46 of the conveyor belt 42 is maintained by the gravity weight of the hooks 64 as well as the tension spring 86.

Referring now to FIG. 4, the structural features of the conveyor belt 42 are shown in greater detail. It will be seen that each conveyor link 44 includes a plurality of like link ends 90 at each respective front and rear end margins 91 and 92 thereof. The front and rear end margins 91 and 92 of each link 44 are provided with mating radiused configurations to prevent link grabbing and jamming. The respective link ends 90 of adjacent links 44 are arranged in spaced, staggered relationship to each other to form a piano-hinge type junction. The respective link ends 90 of adjacent links 44 are each provided with an axial bore 94 which is designed to accommodate a pin 95 which passes through the corresponding bores 94 of the adjoining link ends 90 to form a pivot joint. The pins 95 are provided in a long enough length so that the ends thereof project beyond the bores 94 as shown in FIGS. IA and 4. The ends of the pins 95 engage the upper and lower recesses 35 and 37 to guide the belt 42 in its contoured path defined by the frame 12. Each link 44 includes a heavily-armored planar or pan portion 96 which is bordered by the link ends 90 along each front and rear margin 91, 92 thereof.

The links 44 are alternately provided with a transverse cleat 52. Those links 44 having cleats 52 will be referred to as cleat links **44*a* and those links 44 without cleats will be referred to as pan links 44*b*. Each cleat 52 is provided with an elongate body having a generally planar lower surface 100 and a contoured upper surface 102 including a substantially vertically extending leading edge surface 104, a rounded apex 106 integral with the leading edge surface 104, and a declining portion 108 integral with the apex 106 and having a tapered rear edge. The leading edge surface 104 is slightly curved to facilitate free pivoting action of adjacent links 44. The rounded apex 106 is configured as shown to prevent the edges of improperly oriented tie plates 60 from establishing a hold thereon. Each cleat 52 is releasably secured along its lower surface 100 to the planar pan portion 94 of a cleat link 44*a*** by tack welds or by suitable fasteners such as recessed threaded fasteners (not shown).

The pan links **44*b* are positioned between adjacent cleat links 44*a* so as to define a plate pocket 110. The size of the plate pocket 110 is important to the successful operation of the conveyor 10, for the pockets 110 are dimensioned so that one and only one plate 60 may be properly positioned therein so that the long edges 112 of the plate 60 are directly opposite and in parallel relation to the cleats 52. The plate 60 may be either right side up, with the aforementioned rail securing ribs facing upward, or inverted as it is located in the pocket 110. This orientation of the plate 60 within the pocket 110 (best seen in FIG. 5) will be referred to as proper length-to-width orientation for the operation of the conveyor 10. To encourage the proper orientation of the plates 60 within the pockets 110, the cleats 52 are separated from each other a width or a distance 'T' which is less than the length of a long edge 112 of a plate 60, greater than the length of a short edge or width 114 of one plate 60 and less than twice the length of short edges 114 of a plate 60, such that a plate 60 may either be located properly in the pocket 10 as shown in FIG. 5 or is forced outward thereof at an angle as shown in FIG. 4 (plates 60' and 60''). When plates 60 of various dimensions are used, the pocket dimension 'T' may be altered by changing the position of the cleats 52, or a substitute belt 42 may be provided having the dimensions of the pocket 110 adjusted accordingly to the dimensions of the particular plates 60**.

Referring to FIG. 5, a second dimensional component of the pocket 110 is the height of the cleats 52, designated by reference character H. The height H is preferably less than twice the height of thickness of the plates 60 indicated by the reference character W, so that only one plate 60 may be properly oriented within the pocket 11? . If two plates 60 should be located one directly on top of the other in proper orientation within a pocket 110, the rejecter hooks would remove the upper plate and level it back to the lower end 20 of the conveyor frame 12.

Referring to FIG. 4, the pan links **44*b* may be provided with an upwardly projecting lug 98 positioned at each side end thereof to prevent the lateral misalignment of the plates 60 within the pocket 110 and further to minimize abrasive damage by the plates 60 to the inside faces 39 of the sidewalls 14. The lugs are preferably integral with the link 44*b***.

In operation, the conveyor 10 is fed by dropping a plurality of plates 60 into the hopper 53 by using the industrial electromagnet 62. The plates 60 form a pile 116 within the hopper 53 and on the upper strand 46 of the belt 42 near the lower end 20 of the frame 12. As the belt 42 moves beneath the pile 116, the probability of a plate 60 being initially properly oriented in a pocket 110 is very low. Acceptance of plates 60 within the pockets 110 is greatly increased by continually tumbling the pile 116 by the movement of the belt 42 thereunder, which exposes the plates 60 in the pile 116 to moving plate pockets 110 at a point designated generally by reference numeral 118, where the pile 116 interfaces the belt 42. Plate tumbling is enhanced by the upwardly curved portion B of the belt path. Properly oriented plates 60 travel up the upper strand 46 of the belt 42 to the upper end 16 of the frame 12 for discharge via the discharge chute 32. The center of gravity of an individual plate is toward the upper strand 46 of the conveyor belt 42, and therefore the plates 60 do not fall off the belt.

Referring to FIG. 4, the plates 60' and 60'' are shown in misaligned position. Since the position of plates 60' and 60'', or of any plates 60 not properly located within the pockets 110 is undesirable, it is important to prevent these misaligned plates from reaching the upper end 16 of the conveyor 10. The function of the rejecter hooks 64 is to prevent misaligned plates 60 from reaching the upper conveyor end 16, while not removing plates which are properly located within the pockets 110. Referring now to FIGS. 2A–2D, the sequence of operation of the conveyor 10 when a plate 60 is properly oriented within the pocket 110 is shown. In FIG. 2A, the plate 60 is moving in the direction indicated by the arrow 50 towards the upper end 16 of the conveyor 10 (best seen in FIG. 1). The rejecter hook 64 is biased to contact the upper strand 46 of the belt 42 and to follow the contour thereof as defined by the planar pan portion 94 and the upper surface 102 of the cleats 52. As the belt 42 moves toward the upper end 16 of the conveyor 10, the shoe 78 will encounter the vertical leading edge surface 104 of the cleat 52. The contour of the upper surface 102 of the cleat 52 will cause the hook 64 to pivot upwardly along the arc indicated by the arrow 84.

Referring to FIG. 2B, the rejecter hook 64 is shown in the elevated position and is impacting both the apex 106 of the cleat 52 and the plate 60 properly located within a pocket 110. The shoe 78 is provided with a length 'L' such that the cleat 52 will support the shoe 78 until the leading edge 80 is past the uppermost edge 112 of the plate 60 so as not to interfere with the position of the plate 60 within the pocket 110. Referring to FIG. 2C, once the belt 42 progresses upwardly so that the cleat 52 is no longer in contact with the shoe 78, the biasing force provided by the spring 86 and the weight of the hook 64 cause the shoe 78 to slidingly engage the plate 60. At this point, the shoe 78 cannot interfere with the position of the plate within the pocket 110 and the shoe 78 merely passes over the plate 60. Referring to FIG. 2D, the plate 60 is shown to have passed beneath the shoe 78, which is now engaged by a second cleat 52'.

Referring now to FIGS. 3A–3D, due to the dimensional configuration of the pockets 110, misaligned plates 60 not properly located within the plate pocket 110 protrude above the cleats 52. Protruding plates 60 are stripped off the upper strand 46 by the rejecter hooks 64. Referring to FIG. 3A, the belt 42 is shown moving towards the upper end 16 of the frame 12 in the direction indicated by the arrow 50, and the shoe 78 of the rejecter hook 64 is shown engaging an empty pan link **44*b* of the belt 42. A plate 60 is shown not properly located within the pocket 110 and projecting above the cleat 52 at one short edge 114 thereof. The inclined leading edge 80 of the shoe 78 is adapted to liftingly engage the elevated end 114 of the plate 60. In addition, the vertical edge surface 104 of the cleat 52 is also dimensioned to encourage the sliding action of the edge 80 thereover and into engagement with the end 114 of the plate 60**.

Referring to FIG. 3B, the leading edge 80 of the shoe 78 engages the elevated end 114 of the plate 60 so as to lift the plate 60 out of the pocket 110. The end 114 slides upwardly along the plate rejecter surface 82 with the movement of the belt 42. Referring now to FIG. 3C, the movement of the belt 42 in the direction indicated by the arrow 50, the gravity weight of the rejecter hook 64 and the biasing force exerted on the hook 64 by the spring 86 cause the shoe 78 to exert a greater lifting force upon the elevated plate 60 so that the plate is substantially aligned in parallel relation to the free leg 76 of the rejecter hook 64. Referring to FIG. 3D, as the conveyor belt 42 moves in the upward direction indicated by the arrow 50, the plate 60 moves against the force exerted by the rejecter hook 64 until the plate is rejected from the upper strand 46 of the belt 42 and is returned to the pile 116 of plates 60 located at the lower end 20 of the conveyor frame 12. The steeply inclined configuration of portion C of the conveyor belt path facilitates the return fall of rejected plates to the pile 116.

Consequently, plates 60 properly oriented within the pockets 110 as shown in FIGS. 2A–2D will be conveyed by the conveyor belt 42 to the upper end 16 of the frame 12 to be deposited upon a subsequent plate handling apparatus designed to place the plates in proper orientation for placement upon the rail ties. Those plates 60 which are improperly oriented within the pockets 110 will be engaged by the shoes 78 and the rejecter surfaces 82 and rejected from the pockets 110 by the rejecter hooks 64 and returned to the tumbling pile 116 located at the lower end 20 of the frame 12. The present conveyor is designed to accommodate a plate placement rate of approximately 25–40 plates per minute properly oriented within the pockets 110 and delivered to the upper end 16 of the frame 12. To achieve this rate, it is preferred that a second rejecter hook **64*a* be provided and positioned as shown in FIG. 1 to catch or to reject any plates missed by the first rejecter hook 64. It will be appreciated that additional hooks 64** may be added as needed in certain applications.

While particular embodiments of this apparatus have been described, it will be obvious to a person skilled in the art that changes and modifications might be made without departing from the invention in its broader aspects.

What is claimed is:

1. A sorting conveyor for rail tie plates or the like comprising:

an inclined frame having an upper end and a lower end;

an endless conveyor belt formed of a plurality of links pivotally joined to one another, said links having plate pockets formed thereon, said belt having an upper strand and a lower strand and adapted to travel a continuous path upon said frame between said lower end and said upper end;

means for driving said belt on said frame;

plate supply means adapted to retain a pile of tie plates at said lower end of said conveyor, a first plurality of the plates being wholly retained in said plate pockets of said moving belt, a second plurality of the plates being only partially retained in said pockets and misaligned on said belt; and rejecter means adapted to intercept the misaligned plates carried on said upper strand of said belt and return the intercepted plates to said pile, said rejecter means including at least one rejecter hook mounted to said frame above said working strand of said belt, said hook being biased in a direction opposite to the direction of travel of said upper strand of said belt upon said frame, and being provided with a free end adapted to slidingly engage said upper belt strand.

2. The conveyor described in claim 1 wherein said links each have front and rear edge margins, each of said margins being provided with a plurality of link ends integral therewith, each of said link ends being formed to circumscribe a pivotal bore, said pivotal bores of adjacent edge margins of said links being arranged to be coaxial.

3. The conveyor described in claim 1 wherein said belt includes a first plurality of cleat links, each said cleat link having an upper surface with a cleat transversely mounted thereon, and a second plurality of pan links, each said pan link with a substantially planar upper surface.

4. The conveyor described in claim 3 wherein said cleat links are arranged on said belt so as to alternate with said pan links to define said plate pockets.

5. The conveyor described in claim 1 wherein said pocket is dimensioned to accommodate only one said plate.

6. The conveyor described in claim 5 wherein the plates have a width and a length, said width being shorter than said length, said pocket having a width being longer than said plate width and a length shorter than said plate length so that each plate may only be accommodated in said pocket in a specified length-width orientation.

7. The conveyor described in claim 3 wherein said cleats are removably secured to said cleat links.

8. The conveyor described in claim 7 wherein said cleats each have a generally planar lower surface and a contoured upper surface including a substantially vertical leading edge, a rounded apex and a declining portion.

9. The conveyor described in claim 3 wherein said cleats have a height and said tie plates each have a thickness, said cleat height being greater than said plate thickness.

10. The conveyor described in claim 1 wherein said at least one rejecter hook includes a substantially 'L'-shaped member having a pivot end and a free end.

11. The conveyor described in claim 10 wherein said 'L'-shaped member further includes a pivot leg projecting from said pivot end and integrally intersecting a free leg projecting from said free end at an approximate right angle.

12. The conveyor described in claim 11 wherein said pivot end is attached to said frame for pivotal motion and defines a substantially vertical pivot arc.

13. The conveyor described in claim 11 wherein said free end is provided with a shoe and a plate rejecter surface.

14. The conveyor described in claim 13 wherein said shoe is releasably attached to said free end.

15. The conveyor described in claim 13 wherein said free leg has a downward facing edge margin adapted to have at least a portion of said plate rejecter surface releasably attached thereto.

16. The conveyor described in claim 15 wherein said shoe and said plate rejecter surface form an integral unit adapted for releasable attachment to said free leg.

17. The conveyor described in claim 1 wherein said plate supply means is a hopper having a lower opening in communication with said belt at said lower end of said frame.

18. A sorting conveyor for rail tie plates or the like comprising:

an inclined frame having an upper end and a lower end;

an endless conveyor belt formed of a plurality of links pivotally joined to one another, said links having upper surfaces and adapted to have plate retaining pockets formed thereon, said belt having an upper strand and a lower strand and adapted to travel a continuous path upon said frame between said lower end and said upper end;

means for driving said belt on said frame;

a plate hopper adapted to retain a pile of randomly oriented tie plates at said lower end of said conveyor and in communication with said upper strand, a first plurality of the plates in said pile being wholly retained in said pockets of said moving belt and being conveyed to said upper end of said conveyor, a second plurality of the plates being misaligned and only partially retained in said pockets; and at least one rejecter hook pivotally secured to said frame so as to slidingly contact said upper strand of said belt, said at least one rejecter hook adapted to intercept the misaligned plates carried on said belt, to eject said misaligned plates from said pockets and cause said plates to return to said pile.

19. A rejecter hook for a sorting conveyor for rail tie plates or the like, the conveyor including an inclined frame having an upper end and a lower end, an endless conveyor belt formed of a plurality of links pivotally joined to one another, the links having plate pockets formed thereon, the belt having an upper strand and a lower strand and adapted to travel a continuous path on the frame between the lower end and upper end, means for driving the belt on the frame, and plate supply means adapted to retain a pile of tie plates at the lower end of the conveyor, a first plurality of the plates being wholly retained in the pockets of the moving belt, a second plurality of the plates being only partially retained in the pockets and misaligned on the belt, said rejecter hook comprising:

a substantially 'L'-shaped member having a pivot leg with a pivot end and a free leg with a free end, said pivot leg being joined to said free leg at respective ends thereof opposite said pivot end and said free end to form an approximate right angle;

said pivot end adapted to be pivotally secured to the conveyor frame above said belt;

said free end adapted to slidingly engage the upper belt strand so as to intercept the plates on the conveyor belt upper strand and to eject misaligned plates therefrom; and said rejecter hooks adapted to be biased in a direction opposite the direction of travel of the upper strand of the belt upon the frame.

20. The rejecter hook described in claim 19 wherein said free leg has a wear shoe attached thereto.

21. The rejecter hook described in claim 20 wherein said wear shoe is removably attached to said free end.

22. The rejecter hook described in claim 20 wherein said wear shoe has a leading edge adapted to intercept said plates.

23. The rejecter hook described in claim 20 wherein said free leg has a plate rejecter surface attached along a side edge margin thereof.

24. The rejecter hook described in claim 23 wherein said wear shoe and said plate rejecter surface form an integral, replaceable unit.

25. The rejecter hook described in claim 19 further including biasing means to bias the pivoting action of said hook against the movement of the plates on the conveyor.

26. The rejecter hook described in claim 25 wherein said biasing means includes a spring and an elongate spring support projecting perpendicularly from said pivot arm and having a free end, said free end designed to accept an end of said spring therein, a second end of said spring being connected to said conveyor.

* * * * *

UNITED STATES PATENT AND TRADEMARK OFFICE

CERTIFICATE OF CORRECTION

PATENT NO. : 4,909,375

DATED : March 20, 1990

INVENTOR(S) : Dennis J. Cotic and John L. Thorson

It is certified that error appears in the above-identified patent and that said Letters Patent is hereby corrected as shown below:

In the Abstract, line 12, delete "rejector" and insert --rejecter--;

In the Abstract, line 19, delete "rejector" and insert --rejecter--;

Column 1, line 16, after "Plates"" insert --, as well as the inventions disclosed in copending applications: Serial No. 224,486 filed July 26, 1988 for "Automatic High Speed Tie Plate Reorienting Mechanism" and Serial No. 226,761 filed August 1, 1988 for "Automatic Tie Plate Setting Machine"--;

Column 6, line 26, delete "11?" and insert --110--;

Column 7, line 29, after "have" insert --substantially--;

and

Column 7, line 30, delete "now" and insert --subsequently--.

Signed and Sealed this

First Day of October, 1991

*Attest:*

*Attesting Officer*

HARRY F. MANBECK, JR.

*Commissioner of Patents and Trademarks*